US005504997A

United States Patent [19]

Lee

[11] Patent Number: 5,504,997

[45] Date of Patent: Apr. 9, 1996

[54] BLADE HOLDER ASSEMBLY FOR AN ELECTRIC RAZOR

[76] Inventor: Ming H. Lee, 2F, No. 3, Sec. 2, Zen Hua Rd., Panchiao, Taipei, Taiwan

[21] Appl. No.: 324,669

[22] Filed: Oct. 18, 1994

[51] Int. Cl.[6] ..... B26B 19/10

[52] U.S. Cl. ..... 30/34.1; 30/43.92

[58] Field of Search ..... 30/34.1, 43.92, 30/45, 34.05, 210, 216, 223

[56] References Cited

U.S. PATENT DOCUMENTS

| | | | |
|---|---|---|---|
| 3,962,785 | 6/1976 | Poeh | 30/34.1 X |
| 4,649,642 | 3/1987 | Nagasaki et al. | 30/34.1 |
| 4,845,847 | 7/1989 | Yasunaka et al. | 30/34.1 |
| 5,289,636 | 3/1994 | Eilhhorn et al. | 30/34.1 X |

*Primary Examiner*—Douglas D. Watts

*Attorney, Agent, or Firm*—Bacon & Thomas

[57] ABSTRACT

A blade holder assembly including a casing having a series of teeth along one side for smoothing the hairs or whiskers to be cut and a center opening, a slide plate received in the casing and two bottom mounting rods extended out of the center opening of the casing and coupled to a reciprocating mechanism, a lower blade holder coupled to the slide and having a series of fine cutting teeth and a series of coarse cutting teeth disposed at two opposite sides, an upper cutter blade having a series of fine cutting teeth at one side acted against the fine cutting teeth of the lower blade holder to cut hairs or whiskers, and an upper blade holder fastened to the casing to hold the upper cutter blade above the lower blade holder and having a sloping wall at one side pressed on the upper cutter blade and a series of coarse cutting teeth at an opposite side acted against the coarse cutting teeth of the lower blade holder to cut hairs or whiskers.

8 Claims, 2 Drawing Sheets

BLADE HOLDER ASSEMBLY FOR AN ELECTRIC RAZOR

BACKGROUND OF THE INVENTION

The present invention relates to electric razors, and relates more particularly to a blade holder assembly for an electric razor.

Regular shavers generally have at least one cutter and a trimmer separately arranged and driven to shave the skin or trim the hair. Because the cutter and the trimmer are separately arranged, the cost of the electric razor is expensive. Furthermore, a razor which has only blade type cutters cannot be used to trim the hair.

SUMMARY OF THE INVENTION

The present invention has been accomplished under the circumstances in view. It is therefore an object of the present invention to provide a blade holder assembly for an electric razor which can shave the skin as well as trim the hair. It is another object of the present invention to provide a blade holder assembly for an electric razor which is simple in structure and inexpensive to manufacture. According to the present invention, the blade holder assembly is comprised of a casing, a slide plate received in the casing and reciprocated by a driving mechanism, a lower blade holder coupled to the slide plate and reciprocated by it, an upper cutter blade, and an upper blade holder fastened to the casing to hold the upper cutter blade over the lower blade holder. The lower blade holder has fine cutting teeth and coarse cutting teeth respectively disposed at two opposite sides and reciprocated to act against fine cutting teeth on the upper cutter blade for cutting whiskers and coarse cutting teeth on the upper blade holder for trimming the hair.

DETAILED DESCRIPTION OF THE PREFERRED EMBODIMENT

Figure 1:
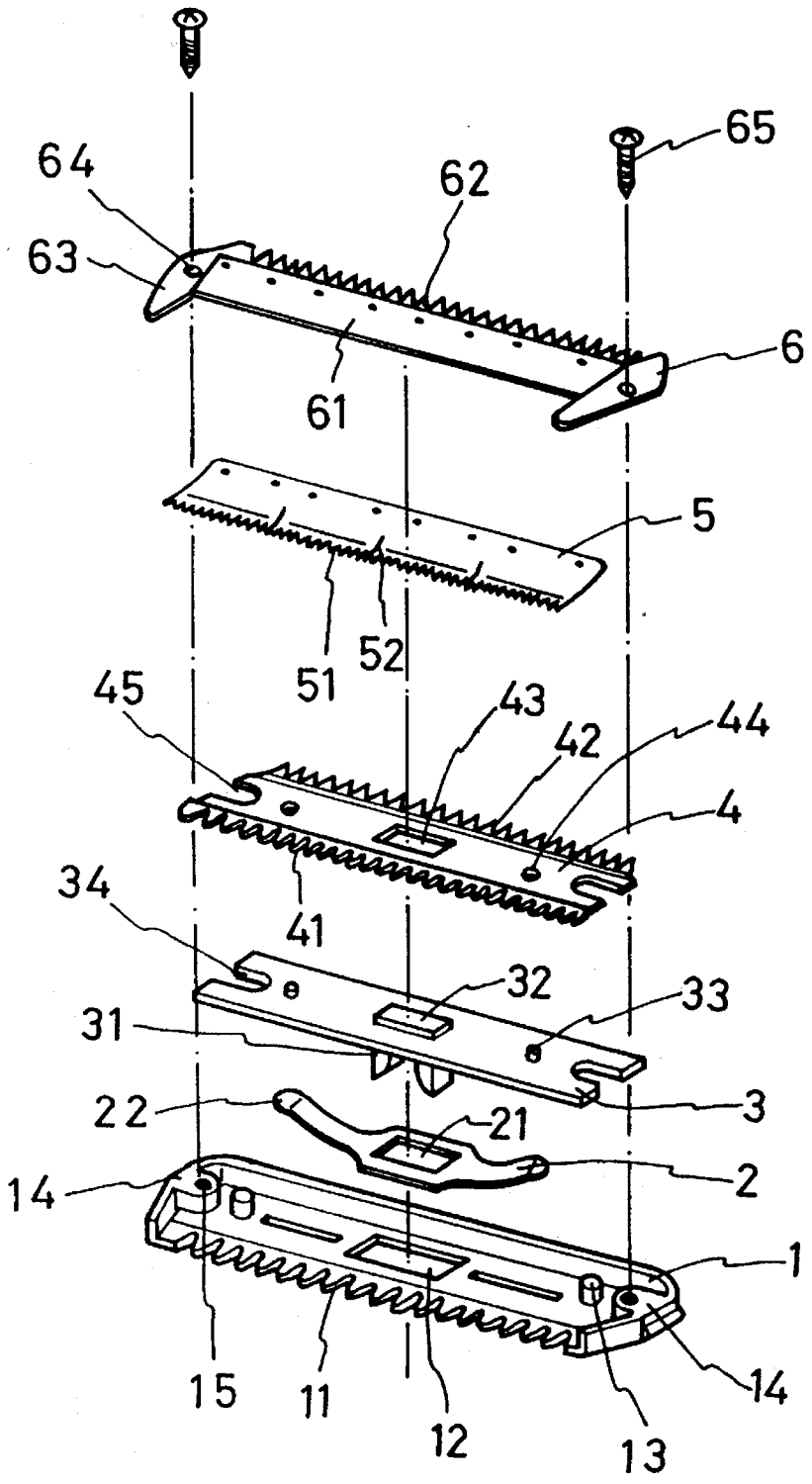
FIG. 1 is an exploded view of a blade holder assembly according to the present invention.

Referring to the annexed drawings in detail, a blade holder assembly for a razor in accordance with the present invention is generally comprised of a casing 1, a slide plate 3, a lower blade holder 4, an upper cutter blade 5, and an upper blade holder 6.

The casing 1 is made of flat shape, having a series of teeth 11 along one side thereof for guiding hairs and whiskers to the upper cutter blade 5 and the lower blade holder 4 for cutting, a center opening 12, two coupling portions 14 disposed near two opposite ends thereof for mounting the upper blade holder 6, and two stop rods 13 respectively disposed near the coupling portions 14 to limit the moving range of the slide plate 3 and the lower blade holder 4 within the casing 1. The coupling portions 14 of the casing 1 have a respective screw hole 15.

The slide plate 3 is received within the casing 1, having two bottom mounting rods 31 inserted through the center opening 12 on the casing 1 and coupled to a driving mechanism (not shown), a raised top block 32 for connection to the lower blade holder 4, two opposite end notches 34 respectively matched with the stop rods 13 of the casing 1, and two stub rods 33 spaced between the end notches 34 and the raised top block 32 for mounting the lower blade holder 4.

The lower blade holder 4 is made from an elongated, flat metal plate, having a series of fine cutting teeth 41 and a series of coarse cutting teeth 42 disposed along two opposite sides thereof, two top stub rods 33, a mounting hole 43, into which the raised top block 32 of the slide plate 3 fits, two opposite end notches 45 respectively aligned with the end notches 34 of the slide plate 3 and matched with the stop rods 13 of the casing 1, two pin holes 44 spaced between the end notches 45 and the mounting hole 43, into which the stub rods 33 of the slide plate 3 fit respectively. When the lower blade holder 4 is coupled to the slide plate 3 and the bottom mounting rods 31 of the slide plate 3 are extended out of the center opening 12 of the casing 1, the slide plate 3 with the lower blade holder 4 can be reciprocated horizontally within the casing 1 between the stop rods 13 of the casing 1.

Figure 2:
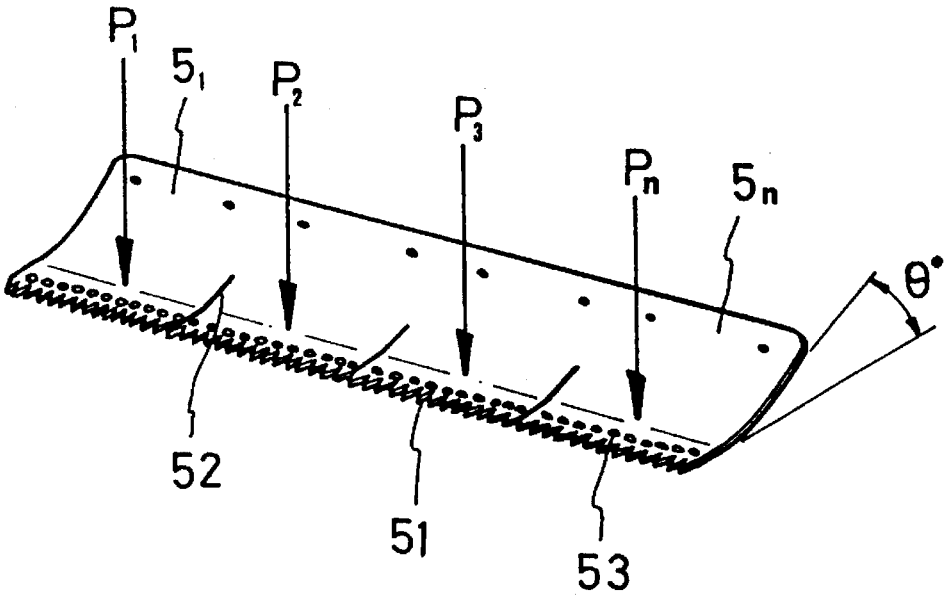
FIG. 2 is a perspective view of an alternate form of the upper blade for the blade holder assembly shown FIG. 1 when compressed.

The upper cutter blade 5 is made from a springy metal plate of thickness about 0.1 mm and fixed to the upper blade holder 6, having a series of fine cutting teeth 51. When pressure is applied to the top side of the upper cutter blade 5 (see FIG. 2), the upper cutter blade 5 will be forced to closely attach to the lower blade holder 4. Because the upper cutter blade 5 is as thin as 0.1 mm, when the blade holder assembly is attached to the skin, the distance between the roots of the whiskers and the fine cutting teeth 41 and 51 of the upper cutter blade 5 and the lower blade holder 4 is tinny, therefore the roots of the whiskers can be easily cut.

The upper cutter blade 5 may be made with a plurality of transverse cuts 52 such that it can be deformed to closely attach to the lower blade holder 4. As an alternate form of the present invention, the upper cutter blade 5 may consist of a plurality of blades $5_1$–$5_n$ arranged in parallel (see FIG. 2). When pressure $P_1$–$P_n$ is applied to the upper cutter blade, the blades $5_1$–$5_n$ are respectively forced to closely attach to the lower blade holder 4.

The fine cutting teeth 51 of the upper cutter blade 5 and the fine cutting teeth 41 of the lower blade holder 4 are acted against each other to cut hairs by scissors action. However, the strength and pitch of the teeth 41 and 51 may affect the probability of whiskers in entering the cutting edge. In order to eliminate this problem, at least one row of slots 53 is made on the upper cutter blade 5 along the fine cutting teeth 51 (see FIG. 2). When whiskers pass over the top of the connecting area of the fine cutting teeth 51 of the upper cutting blade 5, they will be guided into the slots 53 and then cut by the fine cutting teeth 41 of the lower blade holder 4.

The upper blade holder 6 is made from a flat metal plate, having a sloping wall 61 longitudinally disposed at one side and pressed on the upper cutter blade 5, a series of coarse cutting teeth 62 longitudinally disposed at an opposite end and acted against the coarse cutting teeth 42 of the lower blade holder 4 to cut hairs or whiskers, two opposite mounting wings 63 disposed at two opposite ends and respectively fastened to the coupling portions 14 of the casing 1. The mounting wings 63 of the upper blade holder 6 have a respective through hole 64 respectively connected to the screw holes 15 on the coupling portions 14 by a respective screw 65.

During the assembly process, the upper cutter blade 5 is fixed to the upper blade holder 6, then the slide plate 3 is fastened to the lower blade holder 4 by fitting the raised top block 32 and the stub rods 33 into the mounting hole 43 and the pin holes 44, and then slide plate 3 is placed on the casing 1 between the stop rods 13 with the bottom mounting rods 31 extended out of the center opening 12, and then the mounting wings 63 of the upper blade holder 6 are respectively fastened to the coupling portions 14 of the casing 1 by screws 65. When assembled, the upper cutter blade 5 and the slide plate 3 are retained between the upper blade holder 6 and the casing 1 with the lower blade holder 4 retained between them.

Figure 3:
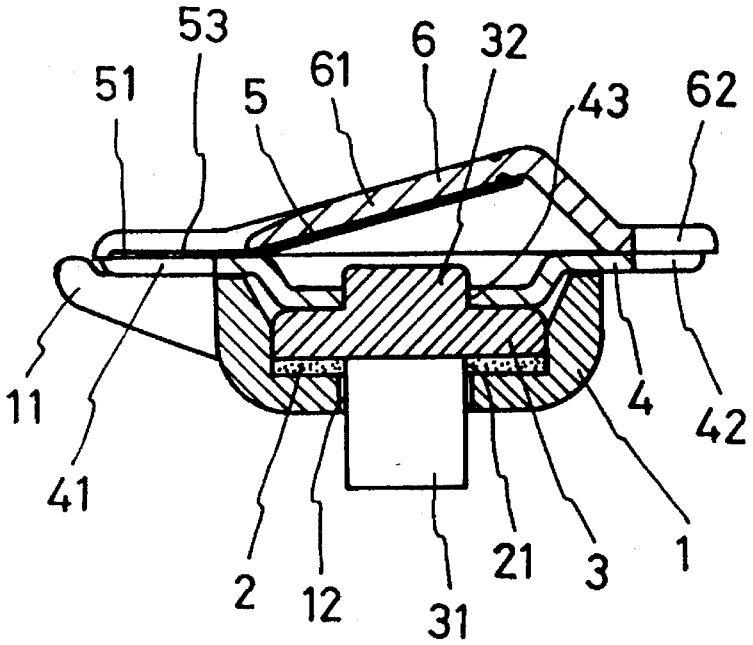
FIG. 3 is a sectional view of a blade holder assembly according to the present invention.

Referring to FIGS. 1 and 3 again, a springy tension plate 2 may be disposed between the slide plate 3 and the casing 1 to support the slide plate 3. The tension plate 2 comprises a center opening 21, through which the bottom mounting rods 31 of the slide plate 3 pass, and two opposite end wings 22 bilaterally curving upwards and stopped against the bottom side of the slide plate 3.

Referring to FIG. 3 again, when the slide plate 3 is reciprocated to shake the lower blade holder 4 relative to the upper cutter blade 5 and he upper blade holder 6, the fine cutting teeth 41 of the lower blade holder 4 act against the fine cutting teeth 51 of the upper cutter blade 5 for shaving the face, the coarse cutting teeth 42 of the lower blade holder 4 act against the coarse cutting teeth 62 of the upper blade holder 6 to trim hairs or whiskers.

Furthermore, the design of the teeth 11 of the casing 1 achieves the following three functions:

1) they smooth the hair, causing the hair to enter the cutting edge;
2) they protect the fine cutting teeth 41 and 51 of the lower blade holder 4 and upper cutter blade 5 against damage; and
3) they protect the skin from the cutting edge during the operation of the electric razor.

It is to be understood that the drawings are designed for purposes of illustration only, and are not intended as a definition of the limits and scope of the invention disclosed.

What is claimed is:

1. A blade holder assembly for an electric razor, comprising:

a casing made of flat shape, having a series of teeth along one side thereof for smoothing hairs or whiskers to be cut, a center opening, and two coupling portions at two opposite ends thereof;

a slide plate received within said casing and reciprocated by the driving mechanism of an electric razor, said slide plate having two bottom mounting rods extended out of the center opening of said casing and coupled to the driving mechanism of an electric razor, and a top block raised from a top wall thereof;

a lower blade holder made from a flat metal plate and coupled to said slide plate, said lower blade holder comprising a series of fine cutting teeth and a series of coarse cutting teeth disposed along two opposite sides thereof, and a mounting hole, which receives the top block of said slide plate permitting said lower blade holder to be reciprocated by said slide plate;

an upper cutter blade made from a springy metal plate, having a series of fine cutting teeth disposed along one side thereof and acted against the fine cutting teeth of said lower blade holder to cut hairs or whiskers; and an upper blade holder made from a flat metal plate fastened to said casing to hold said upper cutter blade above said lower blade holder, having a sloping wall longitudinally disposed at one side and pressed on said upper cutter blade, a series of coarse cutting teeth longitudinally disposed at an opposite end and acted against the coarse cutting teeth of said lower blade holder, and two opposite mounting wings disposed at two opposite ends and respectively fastened to the coupling portions of said casing.

2. The blade holder assembly of claim 1 wherein said casing comprises two opposite stop rods respectively disposed near said coupling portions to limit the reciprocating distance of said slide plate; said slide plate and said lower blade holder have end notches respectively vertically aligned at two opposite ends and moved relative to the stop rods of said casing.

3. The blade holder assembly of claim 1 wherein said lower blade holder comprises two pin holes disposed near two opposite ends thereof; said slide plate comprises two stub rods raised from a top wall thereof and respectively fitted into the pin holes on said lower blade holder.

4. The blade holder assembly of claim 1 wherein said upper cutter blade 5 has a plurality of transverse cuts.

5. The blade holder assembly of claim 1 wherein said upper cutter blade consists of a plurality of blades arranged in parallel and respectively fixed to said upper blade holder.

6. The blade holder assembly of claim 1 wherein said upper cutter blade comprises at least one row of slots disposed along the fine cutting teeth of said upper cutting blade.

7. The blade holder assembly of claim 1 wherein the coupling portions of said casing have a respective screw hole; the mounting wings of said upper blade holder have a respective through hole respectively connected to the screw holes on the coupling portions of said casing.

8. The blade holder assembly of claim 1 further comprising a springy tension plate disposed between said slide plate and said casing, said springy tension plate comprising a center opening, through which the bottom mounting rods of said slide plate pass, and two opposite end wings bilaterally curving upwards and respectively stopped against said slide plate at a bottom.

* * * * *